US009492908B2

(12) United States Patent
Schubert et al.

(10) Patent No.: US 9,492,908 B2
(45) Date of Patent: Nov. 15, 2016

(54) PARTICLE DELIVERY APPARATUSES INCLUDING CONTROL JUNCTIONS FOR USE IN ABRASIVE-JET SYSTEMS AND RELATED APPARATUSES, SYSTEMS, AND METHODS

(71) Applicant: OMAX Corporation, Kent, WA (US)

(72) Inventors: Ernst H. Schubert, Seattle, WA (US); David B. McNiel, Staten Island, NY (US)

(73) Assignee: OMAX Corporation, Kent, WA (US)

( * ) Notice: Subject to any disclaimer, the term of this patent is extended or adjusted under 35 U.S.C. 154(b) by 254 days.

(21) Appl. No.: 14/164,014

(22) Filed: Jan. 24, 2014

(65) Prior Publication Data

US 2014/0213150 A1 Jul. 31, 2014

Related U.S. Application Data

(60) Provisional application No. 61/757,051, filed on Jan. 25, 2013.

(51) Int. Cl.

| | |
|---|---|
| ***B24C 7/00*** | (2006.01) |
| ***B24C 5/02*** | (2006.01) |
| ***B24C 9/00*** | (2006.01) |
| ***B24C 1/04*** | (2006.01) |

(52) U.S. Cl.

CPC ..... *B24C 7/0053* (2013.01); *B24C 1/045* (2013.01); *B24C 5/02* (2013.01); *B24C 7/0046* (2013.01); *B24C 9/00* (2013.01)

(58) Field of Classification Search

CPC ..... B24C 3/12; B24C 5/02; B24C 5/04; B24C 7/00; B24C 7/0015; B24C 7/0038; B24C 7/0046; B24C 7/0053; B24C 7/0092; B24C 9/00

USPC ..... 451/38, 90, 91, 99, 101, 102

See application file for complete search history.

(56) References Cited

U.S. PATENT DOCUMENTS

| | | | | |
|---|---|---|---|---|
| 3,073,070 | A | 1/1963 | Mead | |
| 3,148,484 | A * | 9/1964 | Meek | B24C 7/0046 451/101 |
| 3,201,901 | A | 8/1965 | Pauli | |
| 3,543,444 | A | 12/1970 | Mehta | |
| 3,834,082 | A | 9/1974 | Grudzinski | |
| 4,058,986 | A * | 11/1977 | Granholm | B65G 53/4641 222/368 |
| 4,617,064 | A * | 10/1986 | Moore | B24C 1/003 134/11 |

(Continued)

FOREIGN PATENT DOCUMENTS

| | | | |
|---|---|---|---|
| EP | 0165690 | A2 | 12/1985 |
| GB | 2198975 | A | 6/1988 |

*Primary Examiner* — Eileen Morgan

(74) *Attorney, Agent, or Firm* — Perkins Coie LLP

(57) ABSTRACT

Particle delivery apparatuses for use in abrasive-jet systems and associated apparatuses, systems, and methods are disclosed. A particle delivery apparatus configured in accordance with a particular embodiment includes a cutting head, a gas inlet, and a control junction. An abrasive delivery path extends from a particle hopper toward the cutting head. A gas flow path extends from the gas inlet toward the cutting head. The control junction is configured to collect abrasive particles in a pile that blocks a flow of abrasive particles along the abrasive delivery path. The pile forms when a gas flow rate through a free space around the pile and a pressure differential between the hopper and the abrasive delivery path downstream from the control junction are insufficient to partially or entirely displace the pile.

16 Claims, 8 Drawing Sheets

(56) References Cited

U.S. PATENT DOCUMENTS 5,098,229 A * 3/1992 Meier ..... B65G 53/525 406/194
5,107,630 A 4/1992 Lodewijk
5,109,636 A * 5/1992 Lloyd ..... B24C 7/0092 451/39
5,203,794 A * 4/1993 Stratford ..... B24C 1/003 451/39
5,205,998 A * 4/1993 Boone ..... B01J 3/02 222/195
5,407,379 A * 4/1995 Shank ..... B24C 7/0053 451/101
5,415,584 A * 5/1995 Brooke ..... B08B 7/00 134/7
5,492,497 A * 2/1996 Brooke ..... B08B 7/00 134/7
5,588,901 A * 12/1996 Rubey, III ..... B08B 7/00 134/21
6,390,898 B1 5/2002 Pieper
7,549,911 B2 * 6/2009 Nguyen ..... F16K 39/022 251/121
8,342,912 B2 1/2013 Funatsu et al.
2003/0224704 A1 * 12/2003 Shank ..... B24C 7/0092 451/38
2007/0128988 A1 * 6/2007 Rivir ..... B24C 1/003 451/38
2012/0156969 A1 6/2012 Liu
2012/0196516 A1 8/2012 Funatsu et al.
2013/0105717 A1 * 5/2013 Nguyen ..... F16K 3/246 251/285

* cited by examiner

PARTICLE DELIVERY APPARATUSES INCLUDING CONTROL JUNCTIONS FOR USE IN ABRASIVE-JET SYSTEMS AND RELATED APPARATUSES, SYSTEMS, AND METHODS

CROSS-REFERENCE TO RELATED APPLICATION(S) INCORPORATED BY REFERENCE

This disclosure claims priority to U.S. Provisional Patent Application No. 61/757,051, filed Jan. 25, 2013, entitled "PARTICLE DELIVERY APPARATUSES INCLUDING CONTROL JUNCTIONS FOR USE IN ABRASIVE-JET SYSTEMS AND RELATED APPARATUSES, SYSTEMS, AND METHODS," which is incorporated herein by reference in its entirety.

TECHNICAL FIELD

The present technology relates to delivering particles, such as delivering abrasive particles to a cutting head in an abrasive jet system.

BACKGROUND

Abrasive jet systems are used in precision cutting, shaping, carving, and other material-processing applications. During operation, abrasive jet systems typically direct a high-speed jet of water toward a workpiece to rapidly erode portions of the workpiece. Abrasive particles are added to the water to increase the rate of erosion. When compared to other material-processing or cutting systems (e.g., grinding systems, plasma-cutting systems, etc.), abrasive jet systems can have significant advantages. For example, abrasive jet systems often produce relatively fine and clean cuts, typically without heat-affected zones around the cuts. Abrasive-jet systems also tend to be highly versatile with respect to the material type of the workpiece. The range of materials that can be processed using abrasive jet systems includes very soft materials (e.g., rubber, foam, leather, and paper) as well as very hard materials (e.g., stone, ceramic, and hardened metal). Furthermore, in many cases abrasive-jet systems can execute demanding material-processing operations while generating little or no dust or smoke.

In a typical abrasive-jet system, a pump pressurizes water or another suitable fluid to a high pressure (e.g., 40,000 psi to 100,000 psi or more). Some of this pressurized fluid is routed through a cutting head that includes an orifice plate having an orifice. Passing through the orifice converts static pressure of the fluid into kinetic energy, which causes the fluid to exit the cutting head as a jet at high speed (e.g., up to 2,500 feet-per-second or more) and impact a workpiece. The orifice plate can be a hard jewel (e.g., a synthetic sapphire, ruby, or diamond) held in a suitable mount. In many cases, a jig supports the workpiece. The jig, the cutting head, or both can be movable under computer or robotic control such that complex processing instructions can be executed automatically.

Some conventional abrasive jet systems mix abrasive particles and fluid to form slurry before forming the slurry into a jet. This approach simplifies achieving consistent and reliable abrasive content in the jet, but can cause excessive wear on internal system components as the slurry is pressurized and then formed into the jet. In an alternative approach, abrasive particles are entrained in a fluid after the fluid is formed into a jet (e.g., after the fluid passes through an orifice of an orifice plate). In this approach, the Venturi effect associated with the jet can draw abrasive particles into a mixing chamber along a flow path of the jet. When executed properly, this manner of incorporating particles into a jet can be at least partially self-metering. For example, the replenishment of particles in the mixing chamber can automatically match particle consumption. The equilibrium between particle replenishment and consumption, however, can be sensitive to variations in the particle source upstream from the mixing chamber. In some applications, a large hopper with a direct gravity connection to a mixing chamber is ill-suited for consistent and reliable particle delivery. Large agglomerations of particles can be subject to clumping, rat holes, and other phenomena that can cause variability in and/or degradation of particle flow characteristics. These phenomena are often related to friction between the particles and, therefore, can be dependent on particle size. For example, many forms of undesirable particle behavior can be exacerbated by agglomerations of smaller particles to a greater degree than by agglomerations of larger particles.

In the context of abrasive jet systems, it can be useful to deliver abrasive particles to a cutting head in a consistent, reliable, and cost-effective manner. It can also be useful to enhance coordination between the delivery of abrasive particles and operation of other system components. For these and/or other reasons, there is a need for further innovation in this field.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure. For ease of reference, throughout this disclosure identical reference numbers may be used to identify identical or at least generally similar or analogous components or features.

DETAILED DESCRIPTION

Figure 1:
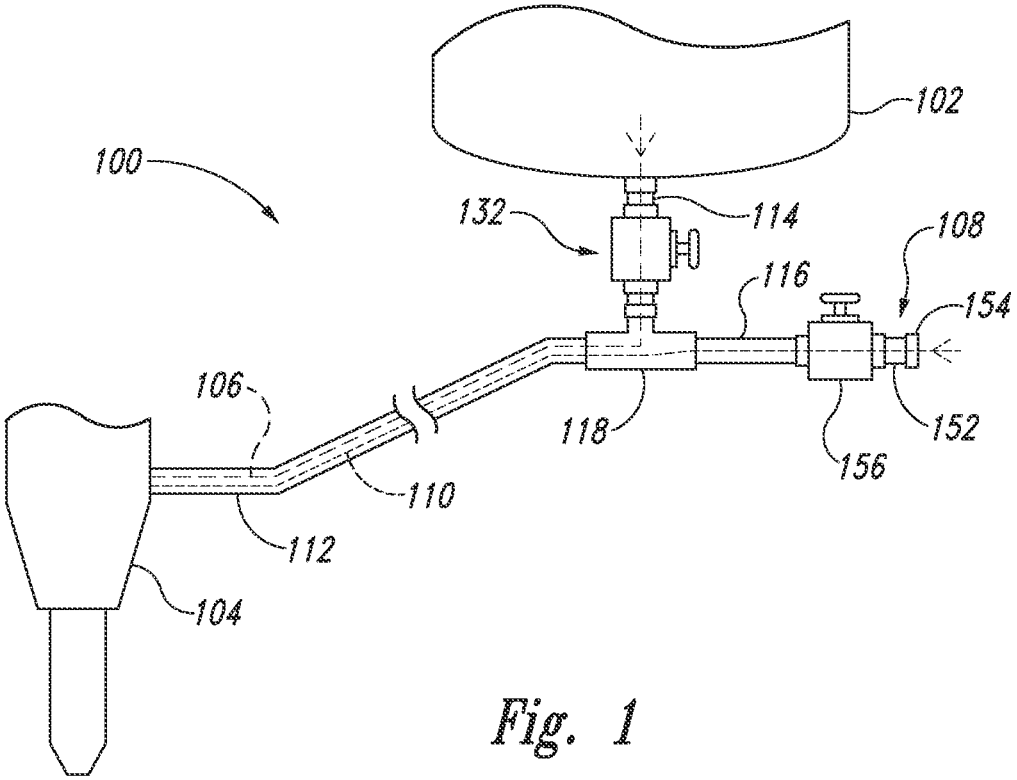
FIG. 1 is a side view illustrating a particle delivery apparatus configured in accordance with an embodiment of the present technology.

Specific details of several embodiments of the present technology are disclosed herein with reference to FIGS.

1-13. Although the embodiments are disclosed herein primarily or entirely with respect to abrasive jet applications, other applications and other embodiments in addition to those disclosed herein are within the scope of the present technology. For example, particle delivery apparatuses configured in accordance with embodiments of the present technology can be useful in some gas-entrained particle blasting applications. It should be noted that abrasive-jet systems configured in accordance with embodiments of the present technology can be used with a variety of suitable fluids, such as water, aqueous solutions, hydrocarbons, glycol, and liquid nitrogen, among others. As such, although the term "waterjet" may be used herein for ease of reference, unless the context clearly indicates otherwise, the term refers to a jet formed by any suitable fluid, and is not limited exclusively to water or aqueous solutions. It also should be noted that embodiments of the present technology can have different configurations, components, or procedures than those shown or described herein. Moreover, a person of ordinary skill in the art will understand that embodiments of the present technology can have components and/or procedures in addition to those shown or described herein and that these and other embodiments can be without several of the components and/or procedures shown or described herein without deviating from the present technology. The headings provided herein are for convenience only.

Conventional abrasive jet systems often include an independently controlled shutoff valve configured to start and stop the flow of abrasive particles toward a cutting head. These valves tend to be expensive, challenging to operate, and/or poorly suited for contact with flowing abrasive particles. For example, some conventional shutoff valves include one or more parts that regularly move in the presence of flowing abrasive particles. Over time, the abrasive particles can wear down these parts and cause the valves to jam or otherwise malfunction. Furthermore, some conventional abrasive jet systems include components configured to vary the flow rate of abrasive particles in addition to merely starting and stopping the flow of abrasive particles. Such components can include, for example, variable-speed vibratory feeders, variable-speed augers, and gravity-drop apparatuses with interchangeable outlet openings having different sizes, among others. Similar to conventional shutoff valves, conventional components configured to vary the flow rate of abrasive particles typically include moving parts that can be highly susceptible to wear and jamming in the presence of flowing abrasive particles. The ability of conventional approaches to precisely vary the flow rate of abrasive particles also tends to be limited. Gravity feeding with interchangeable outlet openings having different sizes is perhaps the most precise conventional approach to varying the flow rate, but space constraints can limit the range of available outlet-opening sizes and can cause this approach to have an excessively limited range of compatible flow rates. This approach also disadvantageously provides coarse-incremental rather than fine-incremental or infinite variability within the range of compatible flow rates.

Particle delivery apparatuses configured in accordance with embodiments of the present technology can at least partially overcome one or more of the disadvantages discussed above and/or other disadvantages of conventional particle delivery apparatuses. For example, a particle delivery apparatus in accordance with an embodiment of the present technology can be configured to automatically start and stop flow of abrasive particles toward a cutting head in response to a change in pressure, gas flow rate, and/or another condition associated with a jet. Rather than relying on an independently controlled shutoff valve, the particle delivery apparatus can include a control junction that automatically operates in concert with the jet. For example, the control junction can be configured to collect abrasive particles in a pile that blocks the flow of abrasive particles under certain conditions and allows the flow of abrasive particles under other conditions. When the jet is off, ramping up, ramping down, and/or operating at low speed, the conditions associated with the jet (e.g., a relatively weak or absent Venturi effect) can cause the pile to form and the flow of abrasive particles to stop. When the jet is operating at high speed, the conditions associated with the jet (e.g., a relatively strong Venturi effect) can cause the pile to be partially or entirely displaced and the flow of abrasive particles to resume. In some cases, the threshold conditions that cause the pile to form (e.g., remain intact) or to be partially or entirely displaced can be controlled to vary the flow rate of abrasive particles. For example, the particle delivery apparatus can include a gas inlet upstream from the control junction, and the gas inlet can be opened or closed to change the threshold conditions.

Examples of Particle Delivery Apparatuses

FIG. 1 is a side view illustrating a particle delivery apparatus 100 configured in accordance with an embodiment of the present technology. The apparatus 100 can include an elevated hopper 102 (e.g., a container configured to hold abrasive particles) and a cutting head 104 at a lower position relative to the hopper 102. A flow of abrasive particles from the hopper 102 toward the cutting head 104 can be at least partially assisted by gravity. For example, an abrasive delivery path 106 (shown as a first dashed line in FIG. 1) extending from the hopper 102 toward the cutting head 104 can have a negative net elevation change in the direction of the cutting head 104. In some embodiments, the apparatus 100 can further include a gas inlet 108 providing gas along a gas flow path 110 (shown as a second dashed line in FIG. 1) extending from the gas inlet 108 toward the cutting head 104. The abrasive delivery path 106 and the gas flow path 110 can extend to the cutting head 104 through one or more conduits. For example, the apparatus 100 can include a first conduit 112 extending between the cutting head 104 and the control junction 118, a second conduit 114 extending between the hopper 102 and the control junction 118, and a third conduit 116 extending between the gas inlet 108 and the control junction 118.

In the illustrated embodiment, the control junction 118 is T-shaped. For example, a portion of the second conduit 114 toward the control junction 118 can be generally vertical and portions of the first and third conduits 112, 116 toward the control junction 118 can be generally horizontal. In other embodiments, the control junction 118 can have other suitable configurations. For example, the portions of the first and third conduits 112, 116 toward the control junction 118 can be generally horizontal and the portion of the second conduit 114 toward the control junction 118 can be at a suitable angle off vertical. In the illustrated embodiment, the abrasive delivery path 106 and the gas flow path 110 merge at the control junction 118. For example, the abrasive delivery path 106 can extend through the second conduit 114, combine with the gas flow path 110 at the control junction 118, and then extend toward the cutting head 104 through the first conduit 112. Similarly, the gas flow path 110 can extend through the third conduit 116, combine with the abrasive delivery path 106 at the control junction 118, and then extend toward the cutting head 104 through the first conduit 112. In other embodiments, the abrasive delivery path 106 and the gas flow path 110 can merge upstream from the control junction 118.

The abrasive delivery path 106 can change direction (e.g., include a corner, angle, bend, elbow, etc.) at the control junction 118. In some embodiments, the abrasive delivery path 106 changes direction at the control junction 118 to form an angle of from about 45 degrees to about 135 degrees (e.g., from about 60 degrees to about 120 degrees) or within another suitable range. For example, the abrasive delivery path 106 can change direction about 90 degrees at the control junction 118. This change of direction can cause abrasive particles to automatically accumulate within the control junction 118 under certain conditions. This can facilitate control over the flow of abrasive particles along the abrasive delivery path 106. For example, as described in greater detail below, the control junction 118 can be configured to start and stop the flow of abrasive particles along the abrasive delivery path 106 without moving any parts along the abrasive delivery path 106.

Figure 2:
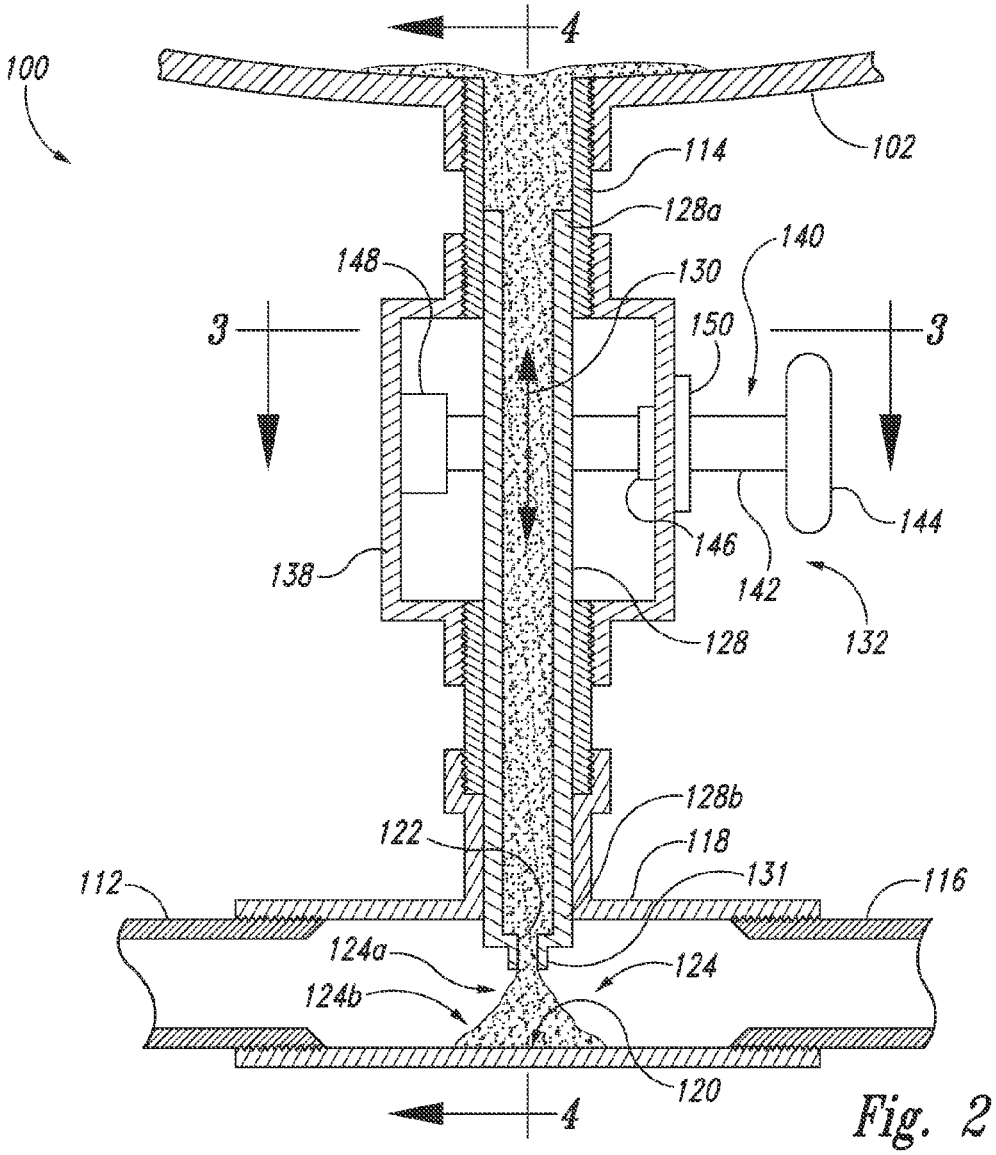
FIG. 2 is an enlarged cross-sectional view illustrating a control junction and associated components of the particle delivery apparatus shown in FIG. 1.
Figure 3:
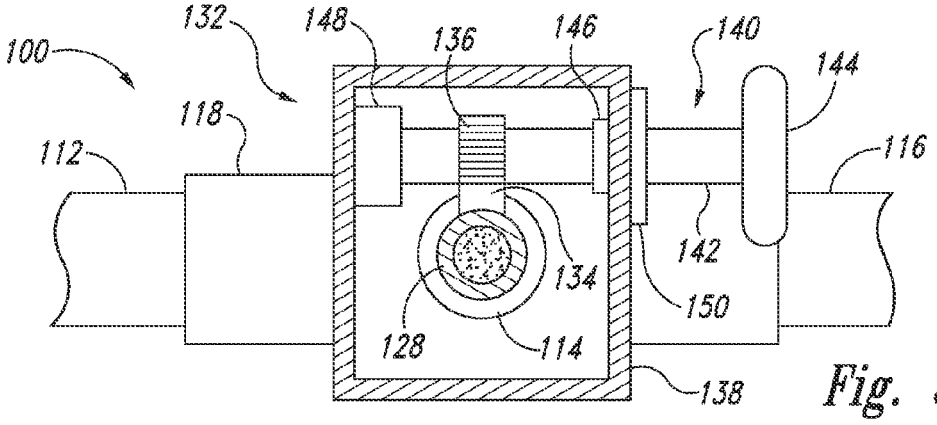
FIGS. 3 and 4 are enlarged cross-sectional views taken along the lines 3-3 and 4-4, respectively, in FIG. 2 illustrating a dispensing tube, an adjustment mechanism, and associated components of the particle delivery apparatus shown in FIG. 1.
Figure 4:
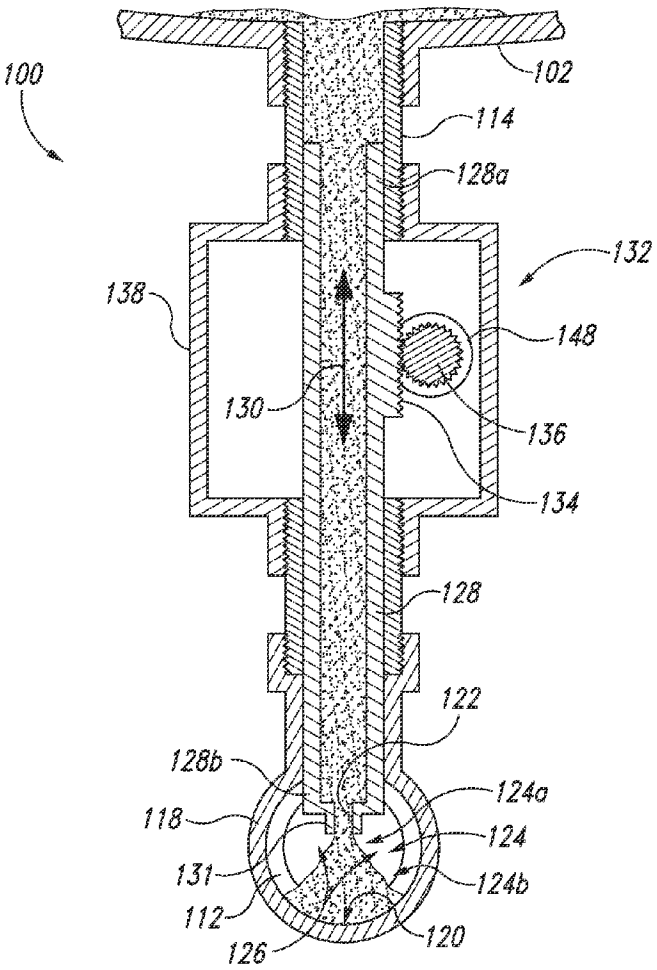

FIG. 2 is an enlarged cross-sectional view illustrating the control junction 118 and associated components of the apparatus 100. FIGS. 3 and 4 are enlarged cross-sectional views taken along the lines 3-3 and 4-4, respectively, in FIG. 2. With reference to FIGS. 2-4 together, the control junction 118 can include a collecting surface 120 configured to support a pile 124 of abrasive particles. The apparatus 100 can include an abrasive port 122 at least proximate to the collecting surface 120. Under certain conditions, the pile 124 can span a gap between the abrasive port 122 and the collecting surface 120 such that a pile upper portion 124*a* mostly or entirely blocks the abrasive port 122. The gas flow path 110 (FIG. 1) can extend through a free space 126 (FIG. 4) on either side of the pile 124. The abrasive particles forming the pile 124 can have a characteristic angle of repose based on, for example, the density, surface area, shape, material type, and/or other properties of the abrasive particles. Without wishing to be bound by theory, it is expected that when the pile 124 spans the gap between the abrasive port 122 and the collecting surface 120, a pile side portion 124*b* will be at the angle of repose and the pile 124 will remain at least generally intact. The pile 124 can form this configuration when an abrasive-jet system including the apparatus 100 is off (e.g., when no jet is flowing through the cutting head 104), ramping up, ramping down, and/or operating at a relatively low speed. When the system is operating at a relatively high speed, the pile 124 can be partially or entirely displaced to unblock the abrasive port 122 and resume the flow of abrasive particles along the abrasive delivery path 106.

The conditions that affect whether the pile 124 remains intact or is partially or entirely displaced can include a gas flow rate along the gas flow path 110, and a pressure differential between the hopper 102 and the abrasive delivery path 106 downstream from the control junction 118, among others. For example, the control junction 118 can be configured to collect abrasive particles in the pile 124 and thereby block the flow of abrasive particles along the abrasive delivery path 106 when (a) the gas flow rate at a portion of the gas flow path 110 extending through the free space 126 is less than a flow rate sufficient to partially or entirely displace the pile 124, and/or (b) a pressure differential between the hopper 102 and the abrasive delivery path 106 downstream from the control junction 118 is less than a pressure differential sufficient to partially or entirely displace the pile 124. Conditions (a) and (b) can be dependent on the Venturi effect associated with a jet 127 flowing through the cutting head 104. For example, the jet 127 can draw gas along the gas flow path 110 by the Venturi effect such that the gas has a sufficient flow rate to partially or entirely displace the pile 124. When the jet 127 stops or moves to a lower steady-state flow rate that sufficiently reduces the Venturi effect, the pile 124 can automatically re-form and stop the flow of abrasive particles along the abrasive delivery path 106. In some embodiments, the pressure differential between the hopper 102 and the abrasive delivery path 106 downstream from the control junction 118 can be dependent on the Venturi effect associated with the jet 127 as well as the pressure of the hopper 102 and the availability of gas from the gas inlet 108. The hopper 102 can be configured to operate at atmospheric pressure or at a pressure less than or greater than atmospheric pressure.

A distance between the abrasive port 122 and the collecting surface 120 can be adjustable to change the size of the pile 124 and/or the size of the free space 126. Adjusting the distance between the abrasive port 122 and the collecting surface 120 can be useful, for example, to change the flow rate of abrasive particles along the abrasive delivery path 106. When the abrasive port 122 is closer to the collecting surface 120, the exposed area of the pile side portion 124*b* is smaller than when the abrasive port 122 is farther from the collecting surface 120. When the exposed area of the pile side portion 124*b* is relatively small, fewer abrasive particles can be carried away by gas flowing through the free space 126 than when the exposed area of the pile side portion 124*b* is larger. Thus, in some embodiments, when a gas flow rate through the free space 126 and a pressure differential between the hopper 102 and the abrasive delivery path 106 downstream from the control junction 118 are sufficient to partially (but not entirely) displace the pile 124, the flow rate of abrasive particles along the abrasive delivery path 106 can be adjusted by changing the distance between the abrasive port 122 and the collecting surface 120. When the gas flow rate through the free space 126 and the pressure differential between the hopper 102 and the abrasive delivery path 106 downstream from the control junction 118 are sufficient to entirely displace the pile 124, the flow rate of abrasive particles along the abrasive delivery path 106 is expected to be generally independent of the distance between the abrasive port 122 and the collecting surface 120. For example, when the pile 124 is entirely displaced, the flow rate of abrasive particles along the abrasive delivery path 106 can depend primarily on the size of the abrasive port 122 and the pressure differential between the hopper 102 and the abrasive delivery path 106 downstream from the control junction 118 and be generally independent of the gas flow rate through the free space 126.

Changing the distance between the abrasive port 122 and the collecting surface 120 and thereby changing the size of the pile 124 and/or the size of the free space 126 can also be useful to control the threshold conditions that cause the pile 124 to form or to be partially or entirely displaced. For example, when a ratio between the size of the free space 126 and the size of the pile 124 is relatively large, a threshold pressure differential at which the pile 124 is partially or entirely displaced can be greater than when the ratio is relatively small. The ratio can be varied within a range from a maximum ratio (e.g., when the abrasive port 122 is at a maximum distance from the collecting surface 120) to a minimum value (e.g., when the abrasive port 122 is in contact with the collecting surface 120). Within the range, the ratio can be varied to control the threshold conditions that cause the pile 124 to form or to be partially or entirely displaced. In some embodiments, it can be useful to use a ratio sufficient to cause remaining abrasive particles within the cutting head 104 and within a portion of the first conduit 112 toward the cutting head 104 to be at least generally cleared after pile 124 forms and before the jet 127 stops. This can be useful, for example, to reduce or eliminate wetting of the remaining abrasive particles as the jet 127 stops. Such wetting can cause residue to accumulate within the first conduit 112, which can disadvantageously affect performance of the apparatus 100 and/or necessitate more frequent maintenance.

In some embodiments, the apparatus 100 includes an elongated dispensing tube 128 having a first end portion 128*a* toward the hopper 102 and a second end portion 128*b* toward the collecting surface 120. The dispensing tube 128 can include a stepped-down portion 131 at the second end portion 128*b* forming the abrasive port 122. For example, an outer diameter of the dispensing tube 128 at the second end portion 128*b* can be less than an outer diameter of the dispensing tube 128 at the first end portion 128*a*. The stepped-down portion 131 can be useful, for example, to increase the free space 126 when the dispensing tube 128 is lowered toward the collecting surface 120. In other embodiments, the dispensing tube 128 can have another suitable shape. The dispensing tube 128 can be moveable back and forth relative to the collecting surface 120 along an adjustment axis 130 to adjust the distance between the abrasive port 122 and the collecting surface 120. In other embodiments, the dispensing tube 128 can have a fixed position relative to the collecting surface 120. The collecting surface 120 can be curved about an axis generally perpendicular to the adjustment axis 130 or have other suitable shapes (e.g., flat, V-shaped, etc.).

The dispensing tube 128 can be configured to be manually or automatically moved, for example, during routine operation of the apparatus 100, during calibration of the apparatus 100 (e.g., during factory calibration), and/or at other suitable times. The apparatus 100 can include a suitable adjustment mechanism 132 for moving the dispensing tube 128 back and forth along the adjustment axis 130. For example, the mechanism 132 can include a series of first gear teeth 134 (e.g., on a rack, a worm, etc.) coupled to the dispensing tube 128 in cooperative engagement with a series of second gear teeth 136 (e.g., on a pinion, a spur gear, etc.). The apparatus 100 can further include a housing 138 and a handle 140 having an axle 142 extending through a hole (not shown) in the housing 138. The second gear teeth 136 can extend circumferentially around a first intermediate portion of the axle 142. The handle 140 can include a grip 144 at one end of the axle 142, a stub (not shown) at an opposite end of the axle 142, and a stop 146 extending circumferentially around a second intermediate portion of the axle 142 between the second gear teeth 136 and the grip 144. With the stop 146 abutting an inside surface of the housing 138, the stub can be rotatably received within a seat 148 in the housing 138 and the second gear teeth 136 can be meshed with the first gear teeth 134. The mechanism 132 can include a plate 150 on the outside of the housing 138 having markings (not shown) configured to indicate the distance between the abrasive port 122 and the collecting surface 120 based on a rotational position of the axle 142. Manual rotation of the grip 144 can cause the dispensing tube 128 to move along the adjustment axis 130 from a first end position to a second end position and through a range of intermediate positions. At the first and second end positions, contact between the first gear teeth 134 and the housing 138 and/or between the second end portion 128*b* and the collecting surface 120 can limit additional movement of the dispensing tube 128.

With reference again to FIG. 1, the gas inlet 108 can include a filter 152 coupled to a vent 154, and a valve 156 downstream from the vent 154. The vent 154 can be open to the atmosphere, and the filter 152 can be configured to reduce or eliminate the intake of airborne contaminants (e.g., particulates and/or moisture) into the apparatus 100 via the vent 154. The valve 156 can be configured to control the gas flow rate along the gas flow path 110. In addition or alternatively, the valve 156 can be configured to control the pressure differential between the hopper 102 and the abrasive delivery path 106 downstream from the control junction 118. For example, the valve 156 can be operated to move the gas inlet 108 from a first state (e.g., a generally closed first state) to a more open second state. Moving the gas inlet let 108 from the first state toward the second state while the jet 127 draws gas along the gas flow path 110 can increase the gas flow rate along the gas flow path 110 and decrease the pressure differential between the hopper 102 and the abrasive delivery path 106 downstream from the control junction 118. Similarly, moving the gas inlet 108 from the second state toward the first state while the jet 127 draws gas along the gas flow path 110 can decrease the gas flow rate along the gas flow path 110 and increase the pressure differential between the hopper 102 and the abrasive delivery path 106 downstream from the control junction 118.

Figure 5:
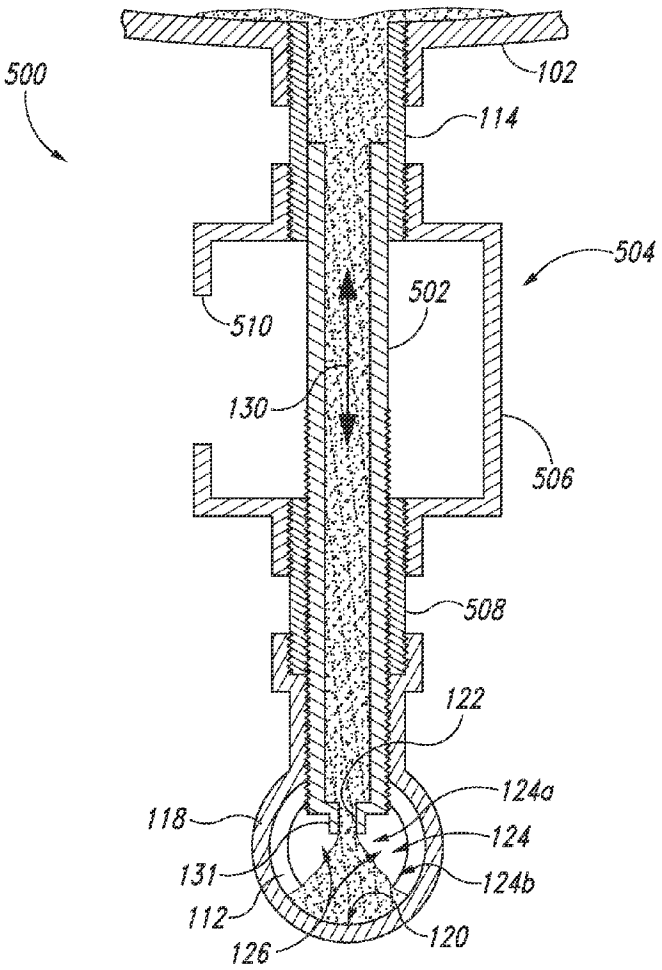
FIGS. 5-8 are enlarged cross-sectional views illustrating portions of particle delivery apparatuses configured in accordance with additional embodiments of the present technology.

FIG. 5 is an enlarged cross-sectional view illustrating a portion of a particle delivery apparatus 500 configured in accordance with an additional embodiment of the present technology. The apparatus 500 can include a dispensing tube 502, an adjustment mechanism 504 having a housing 506, and a conduit segment 508 extending between the housing 506 and the control junction 118. The dispensing tube 502 can include external threads that cooperatively engage internal threads along a bore extending through the conduit segment 508 and a portion of the control junction 118. When the dispensing tube 502 is manually rotated relative to the conduit segment 508, the dispensing tube 502 moves up or down along the adjustment axis 130. The housing 506 can include an opening 510 for accessing the dispensing tube 502 for manual movement.

Figure 6:
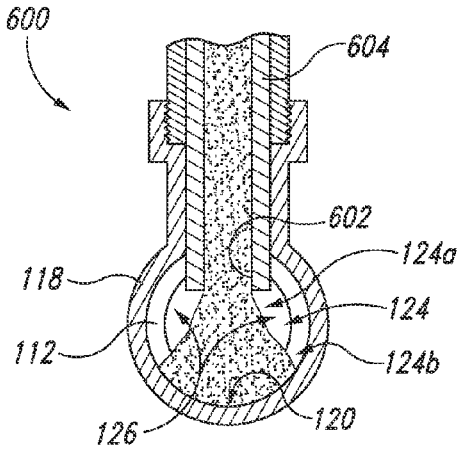
Figure 7:
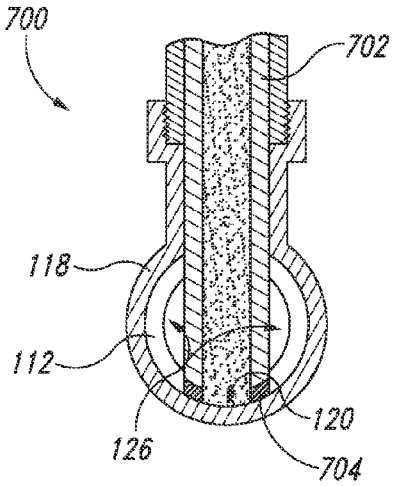
Figure 8:
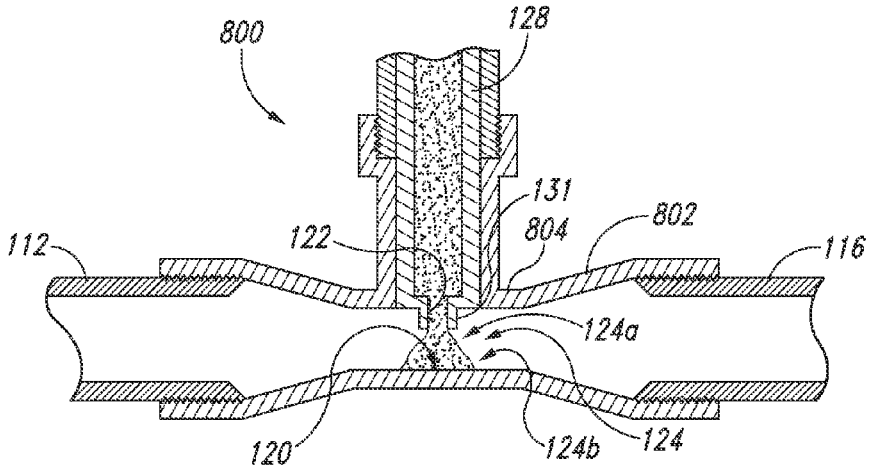

FIGS. 6-8 are enlarged cross-sectional views illustrating portions of particle delivery apparatuses 600, 700 and 800 configured in accordance with additional embodiments of the present technology. With reference to FIG. 6, the apparatus 600 can include a dispensing tube 602 forming an abrasive port 604 that is larger than the abrasive port 122 (FIG. 4). For example, the dispensing tube 602 can have a consistent outer diameter toward the collecting surface 120. In some embodiments, the abrasive port 602 can facilitate the use of larger abrasive particles and/or greater flow rates of abrasive particles relative to the abrasive port 122.

With reference to FIG. 7, the apparatus 700 can include a dispensing tube 702 having a gasket 704 configured to press against the collecting surface 120. In some embodiments, pressing the gasket 704 against the collecting surface 120 can completely stop the flow of abrasive particles independently with respect to conditions that would otherwise affect whether the pile 124 (FIG. 4) remains intact or is partially or entirely displaced. This feature can be useful, for example, as an alternative (e.g., a backup, override, default, etc.) mechanism for controlling the flow of abrasive particles along the abrasive delivery path 106 (FIG. 1). With reference to FIG. 8, the apparatus 800 can include a control junction 802 having a Venturi restriction 804. This feature can be useful, for example, to locally increase the gas flow rate at a portion of the gas flow path 110 (FIG. 1) extending through the free space 126 (FIG. 4) around the pile 124.

When the gas flow rate through the control junction 802 is variable, the Venturi restriction 804 can, in at least some cases, increase an upper limit of an available range of gas flow rates through the control junction 802.

Figure 9:
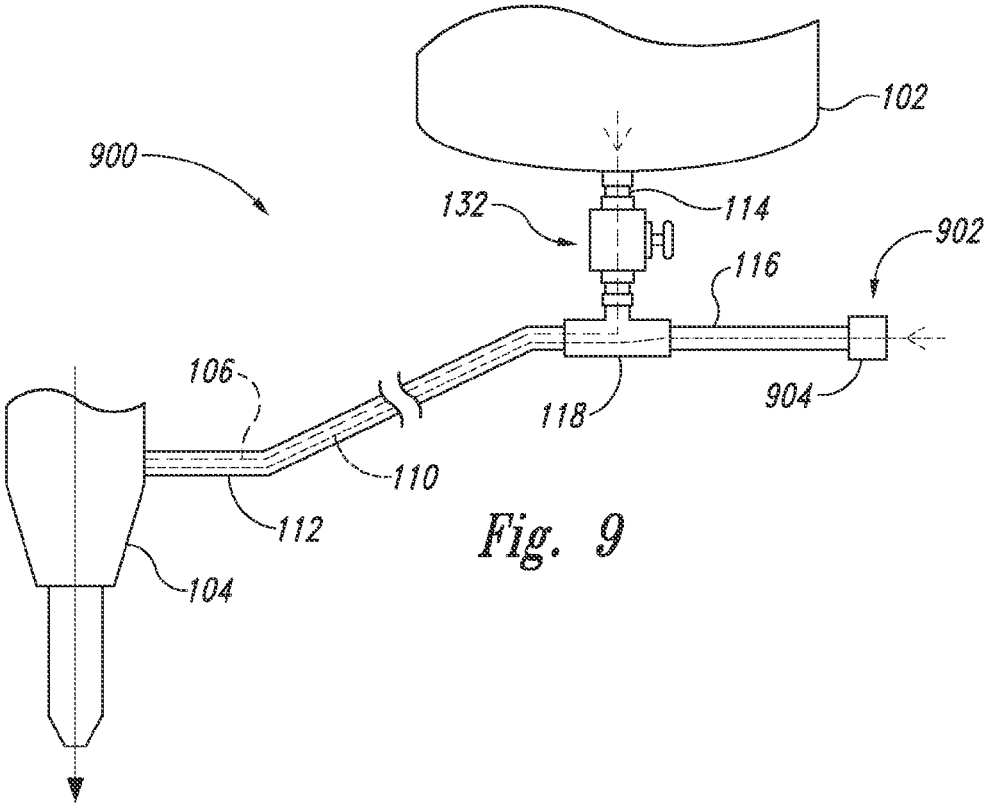
FIGS. 9-11 are side views illustrating particle delivery apparatuses configured in accordance with additional embodiments of the present technology.
Figure 10:
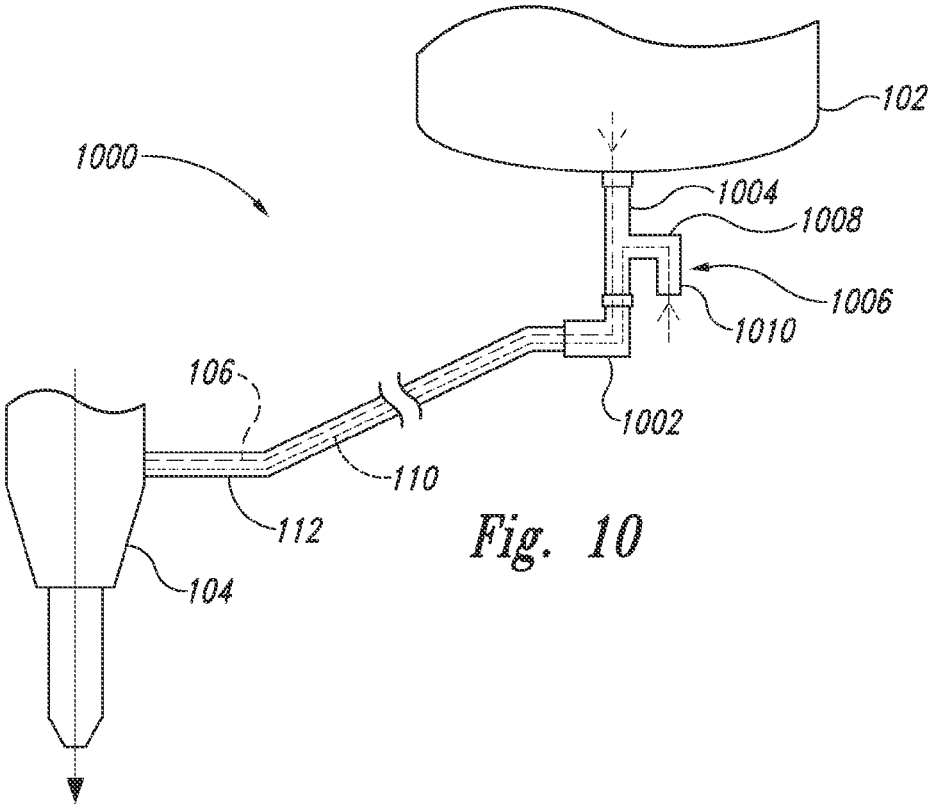

FIGS. 9 and 10 are side views illustrating particle delivery apparatuses 900, 1000 configured in accordance with additional embodiments of the present technology. With reference to FIG. 9, the apparatus 900 can include a gas inlet 902 having a pneumatic coupler 904 configured to be connected to a pressurized gas source (not shown). Supplying pressurized gas to the apparatus 900 rather than drawing gas from the atmosphere can enhance control over the gas flow rate along the gas flow path 110. For example, the pressure of the incoming gas can be selected to control the threshold conditions that cause abrasive particles to flow toward the cutting head 104 along the abrasive delivery path 106. With reference to FIG. 10, the apparatus 1000 can include a conduit 1002 between an L-shaped control junction 1004 and the hopper 102, and a gas inlet 1006 at an intermediate position along the conduit 1002. The gas inlet 1006 can include a branch 1008 connected to the conduit 1002 at one end and having a downward-facing vent 1010 at an opposite end. With reference to FIGS. 1, 9 and 10 together, a variety of other suitable configurations, shapes, and other features of the control junctions 118, 1002, and gas inlets 108, 902, 1006 are also possible.

Figure 11:
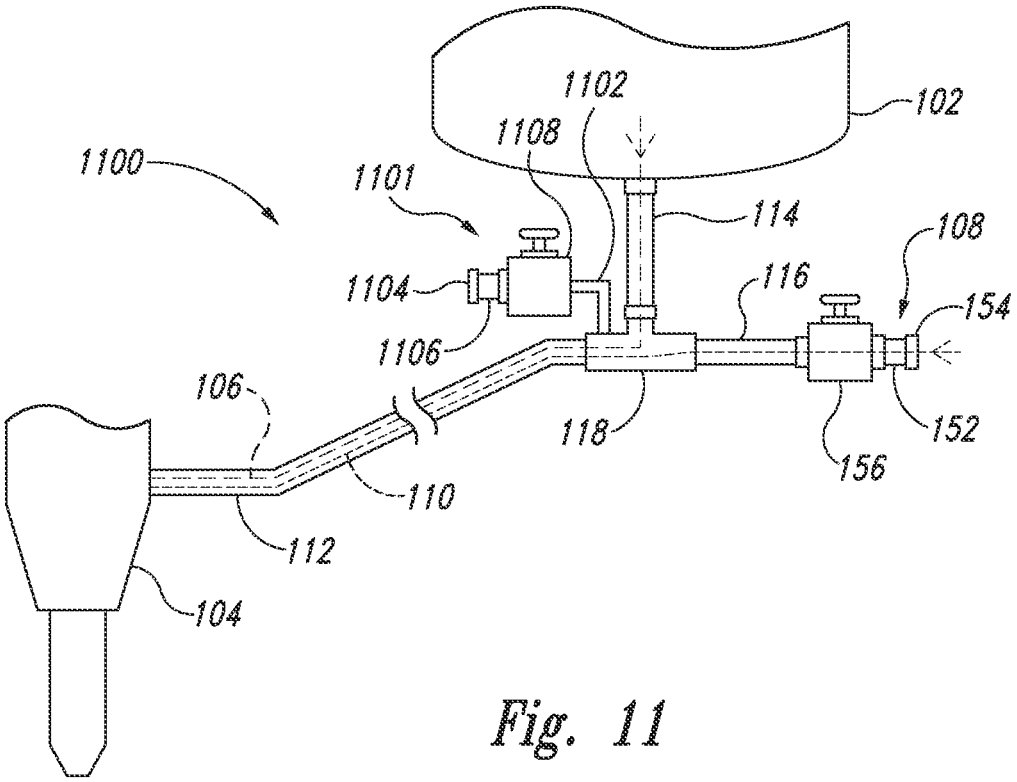

FIG. 11 is a side view illustrating a particle delivery apparatuses 1100 configured in accordance with another embodiment of the present technology. The apparatus 1100 can include an additional gas inlet 1101 and a fourth conduit 1102 extending between the additional gas inlet 1101 and a portion of the control junction 118 (or the first conduit 112) downstream from a position within the control junction 118 at which the pile of abrasive particles 124 (FIG. 2) forms. The additional gas inlet 1101 can include a filter 1104 coupled to a vent 1106, and a valve 1108 downstream from the vent 1106. The filter 1104 can be configured to reduce or eliminate the intake of airborne contaminants (e.g., particulates and/or moisture) into the apparatus 1100 via the vent 1106. In some embodiments, the valve 1108 can be used as a substitute for or in addition to the adjustment mechanism 132 (FIG. 1) and/or the valve 156. For example, similar to adjustment mechanism 132 and the valve 156, the valve 1108 can be used to control the gas flow rate along the gas flow path 110 and, in turn, to control the threshold conditions that cause the pile to form or to be partially or entirely displaced. In other embodiments, the additional gas inlet 1101 can be non-adjustable. For example, the additional gas inlet 1101 can include an opening having a fixed size selected to cause a desired gas flow rate along the gas flow path 110 under standard operating conditions for the apparatus 1100.

Examples of Abrasive-Jet Systems

Figure 12:
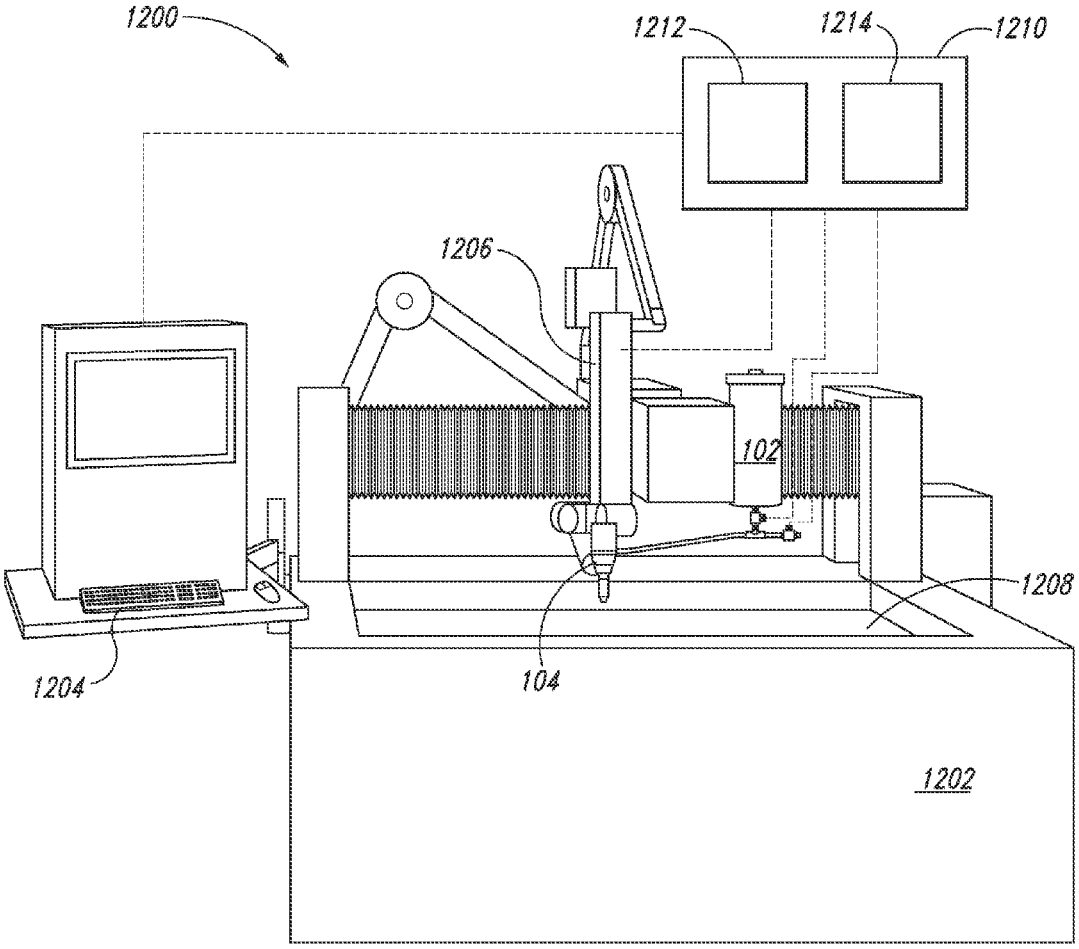
FIG. 12 is a perspective view illustrating an abrasive jet system including the particle delivery apparatus shown in FIG. 1 configured in accordance with an embodiment of the present technology.

FIG. 12 is a perspective view of an abrasive jet system 1200 including the apparatus 100 (FIG. 1) configured in accordance with an embodiment of the present technology. The apparatus 100 can be original to or a retrofit to the system 1200. The system 1200 can include a base 1202, a user interface 1204 supported by the base 1202, and an actuator assembly 1206 configured to move the apparatus 100 relative to the base 1202. For simplicity, FIG. 12 does not show a number of components (e.g., a fluid source, a pump, an intensifier, etc.) typically associated with generating a fluid jet upstream from the cutting head 104. Such components can be operably connected to the cutting head 104. Within the cutting head 104, abrasive particles can accelerate with the jet before being directed toward a workpiece (not shown) held in a jig (not shown). The base 1202 can include a diffusing tray 1208 configured to diffuse energy of the jet after it passes through the workpiece. The system 1200 can also include a controller 1210 (shown schematically) operably connected to the user interface 1204, the actuator assembly 1206, the gas inlet 108, and the adjustment mechanism 132. The controller 1210 can include a processor 1212 and memory 1214 and can be programmed with instructions (e.g., non-transitory instructions) that, when executed, change operation of the system 1200.

In some embodiments, the user interface 1204 is configured to receive user commands corresponding to desired flow rates of abrasive particles. The commands, for example, can be abrasive jet settings, such as jet diameters or jet speeds. The controller 1210 can be programmed with rates of particle consumption desirable for various settings. For example, larger-diameter abrasive jets and faster abrasive jets typically call for greater rates of particle consumption. The commands also can be direct commands for flow rates of abrasive particles. The controller 1210 can be configured to generate the commands automatically. Furthermore, a user may use the user interface 1204 to instruct the controller 1210 to increase or decrease the flow rate of abrasive particles so as to increase or decrease the rate of erosion occurring on the workpiece. Based on the commands or other instructions, the controller 1210 can automatically adjust the gas inlet 108 and/or the adjustment mechanism 132 to cause the desired flow rates of abrasive particles.

In some embodiments, the apparatus 100 can be more dynamic and/or responsive than conventional particle delivery apparatuses. For example, in some embodiments, after a user command is entered into the user interface 1204, the quantity of particles within a jet exiting the cutting head 104 can change according to the command and return to steady state in less than about 5 seconds (e.g., less than about 3 seconds, such as less than about 1 second) or within another suitable range. Furthermore, the controllable increments of particle delivery rate can be relatively small, such as less than about 0.2 kg/minute (e.g., less than about 0.1 kg/minute, such as less than about 0.05 kg/minute) or within another suitable range. Specified particle delivery rates can also be provided with a high degree of precision. For example, at a given particle delivery rate (e.g., either directly specified or corresponding to another specified parameter), the apparatus 100 can achieve the particle delivery rate at steady state with variability less than about 0.05 kg/mi (e.g., less than about 0.03 kg/minute, such as less than about 0.01 kg/minute) or within another suitable range.

Examples of Particle Delivery Methods

Figure 13:
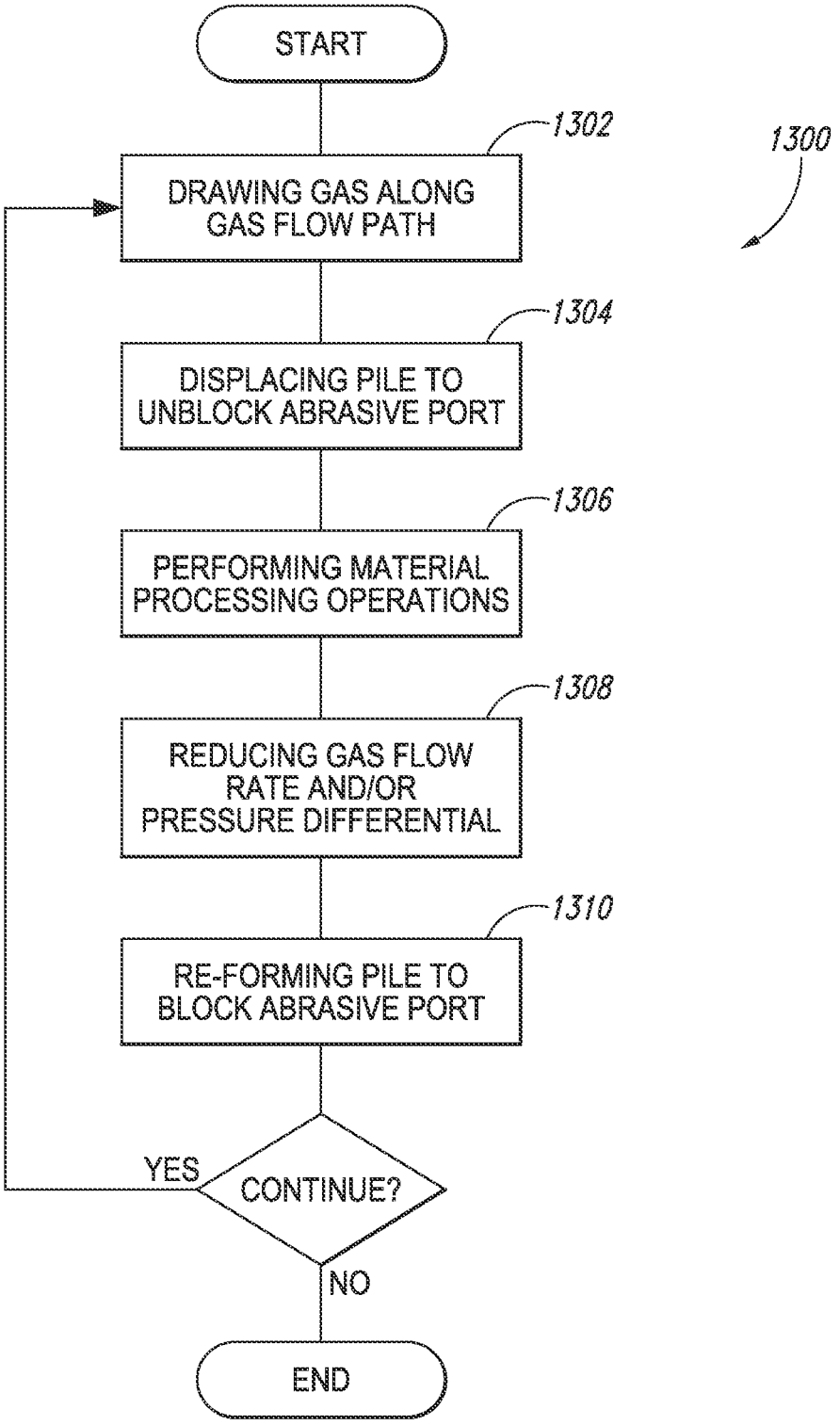
FIG. 13 is a flow chart illustrating a method for delivering abrasive particles with the system shown in FIG. 12 in accordance with an embodiment of the present technology.

FIG. 13 is a flow chart illustrating a method 1300 for delivering abrasive particles within the system 1200 in accordance with an embodiment of the present technology. With reference to FIGS. 1-4 and 13 together, the method 1300 can include forming a jet 127 with the cutting head 104 to draw gas from the gas inlet 108 toward the cutting head 104 along the gas flow path 110 (box 1302). The gas can partially or entirely displace the pile 124 of abrasive particles within the control junction 118, which can unblock the abrasive port 122 and allow abrasive particles to flow from the hopper 102 toward the cutting head 104 along the abrasive delivery path 106 (box 1304). The supply of abrasive particles in the hopper 102 can be replenished as needed (e.g., intermittently or continuously).

While the abrasive particles flow to the cutting head 104, the jet 127 can be used to perform useful material processing operations (box 1306). The jet 127 can then be stopped and/or slowed to reduce the gas flow rate through the control junction 118 and/or a pressure differential between the hopper 102 and the abrasive delivery path 106 downstream from the control junction 118 (box 1308). This can cause the pile 124 to automatically re-form within the control junction 118 so as to block the abrasive port 122 (box 1310). For example, abrasive particles can flow from the abrasive port 122 onto the collecting surface 120 until the pile 124 spans a gap between the abrasive port 122 and the collecting surface 120. In some embodiments, the jet 127 slows and then stops and the pile 124 re-forms before the jet 127 stops. Before the jet 127 stops and after the pile 124 forms, the jet 127 can draw enough gas along the gas flow path 110 to at least partially clear remaining abrasive particles from the abrasive delivery path 106. As discussed above, this can be useful, for example, to reduce or eliminate wetting of the remaining abrasive particles as the jet 127 stops.

In some embodiments, the system 1200 is capable of operating the jet 127 at different steady-state speeds. The apparatus 100 can be configured to automatically change the delivery of abrasive particles to the cutting head 104 in response to this changing operation of the jet 127. For example, the jet 127 can be operated at a first steady-state speed to cause a first steady-state abrasive flow rate along the abrasive delivery path 106 and then operated at a second, different steady-state speed to cause a second, different steady-state abrasive flow rate along the abrasive delivery path 106. Furthermore, even when the jet 127 is operated at a single steady-state speed, the gas inlet 108 and/or the adjustment mechanism 132 can be controlled (e.g., manually or automatically) to change the delivery of abrasive particles to the cutting head 104. For example, the jet 127 can be operated at a steady-state speed to cause a first steady-state abrasive flow rate along the abrasive delivery path 106 and then, while the jet 127 is operating at the steady-state speed, the gas inlet 108 can be at least partially closed and/or the distance between the abrasive port 122 and the collecting surface 120 can be changed to cause a second, different steady-state abrasive flow rate along the abrasive delivery path 106.

In some embodiments, the gas inlet 108 can be mostly or entirely closed to cause delivery of abrasive particles in a first regime in which the flow rate of abrasive particles along the abrasive delivery path 106 depends primarily or entirely on the pressure differential between the hopper 102 and the abrasive delivery path 106 downstream from the control junction 118 rather than on the gas flow rate through the control junction 118. In other embodiments, the gas inlet 108 can be mostly or entirely opened to cause delivery of abrasive particles in a second regime in which the abrasive flow rate depends primarily or entirely on the gas flow rate through the control junction 118 rather than the pressure differential between the hopper 102 and the abrasive delivery path 106 downstream from the control junction 118. The first and second regimes are expected to have different characteristics. In the first regime, for example, the pile 124 can be completely displaced, while in the second regime, the pile 124 can be partially displaced. The flow rate of abrasive particles along the abrasive delivery path 106 is expected to be greater in the first regime than in the second regime, but more precisely controllable in the second regime than in the first regime. Other characteristics are also possible. In some embodiments, moving between the first and second regimes occurs via changes in operation of the jet 127 rather than changes in control of the gas inlet 108. Furthermore, delivery of abrasive particles can be in the first regime even when the gas inlet 108 is fully opened, and delivery of abrasive particles in the second regime can occur when the jet 127 is ramping up, ramping down, and/or operating at low speed.

The apparatus 100 and other particle delivery apparatuses configured in accordance with embodiments of the present technology can be used with a variety of different types (e.g., sizes, material types, etc.) of abrasive particles. For example, using smaller abrasive particles may be desirable when the size of the jet 127 is smaller (e.g., in micromachining applications) or when an application calls for minimal surface roughness around a cut. Conversely, use of larger abrasive particles may be desirable when cutting particularly hard materials or when a rapid rate of material removal is paramount. Suitable abrasive particle sizes include mesh sizes from about #36 to about #320, as well as other smaller and larger sizes. Abrasive particles having different compositions also can be used according to the requirements of different applications. Examples of suitable abrasive particle materials include garnet, aluminum oxide, silicon carbide, and sodium bicarbonate, among others.

Conclusion

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown or described in detail to avoid unnecessarily obscuring the description of the embodiments of the present technology. Although steps of methods may be presented herein in a particular order, alternative embodiments may perform the steps in a different order. Similarly, certain aspects of the present technology disclosed in the context of particular embodiments can be combined or eliminated in other embodiments. Furthermore, while advantages associated with certain embodiments of the present technology may have been disclosed in the context of those embodiments, other embodiments can also exhibit such advantages, and not all embodiments need necessarily exhibit such advantages or other advantages disclosed herein to fall within the scope of the present technology. Accordingly, this disclosure and associated technology can encompass other embodiments not expressly shown or described herein.

Certain aspects of the present technology may take the form of computer-executable instructions, including routines executed by a controller or other data processor. In some embodiments, a controller or other data processor is specifically programmed, configured, or constructed to perform one or more of these computer-executable instructions. Furthermore, some aspects of the present technology may take the form of data (e.g., non-transitory data) stored or distributed on computer-readable media, including magnetic or optically readable or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

We claim:

1. A particle delivery apparatus, comprising:
a cutting head;
an abrasive delivery path extending from a hopper toward the cutting head;
a gas flow path extending from a gas inlet toward the cutting head;
a control junction joining the abrasive delivery path to the gas flow path, the control junction being configured to collect abrasive particles in a pile that blocks a flow of abrasive particles along the abrasive delivery path when (a) a gas flow rate at a portion of the gas flow path extending through a free space around the pile is less than a flow rate sufficient to partially or entirely displace the pile and (b) a pressure differential between the hopper and the abrasive delivery path downstream from the control junction is less than a pressure differential sufficient to partially or entirely displace the pile, wherein the control junction includes a collecting surface configured to support the pile; and
an abrasive port at least proximate to the control junction, wherein a distance between the abrasive port and the collecting surface is adjustable to change a size of the pile, a size of the free space, or both.

2. The apparatus of claim 1 wherein the gas inlet includes a vent configured to be open to the atmosphere.

3. The apparatus of claim 1 wherein the gas inlet includes a pneumatic coupler.

4. The apparatus of claim 1 wherein the abrasive delivery path changes direction about 90 degrees at the control junction.

5. The apparatus of claim 1 wherein the control junction is generally T-shaped.

6. The apparatus of claim 1, further comprising:
a first conduit extending between the cutting head and the control junction;
a second conduit extending between the hopper and the control junction, the second conduit having a generally horizontal portion toward the control junction; and
a third conduit extending between the gas inlet and the control junction, the third conduit having a generally horizontal portion toward the control junction,
wherein
the abrasive delivery path extends though the first and second conduits, and
the gas flow path extends through the first and third conduits.

7. The apparatus of claim 1 wherein the collecting surface is within a Venturi restriction.

8. The apparatus of claim 1, wherein the control junction is configured to start and stop the flow of abrasive particles along the abrasive delivery path without moving any parts along the abrasive delivery path.

9. The apparatus of claim 1 wherein:
the gas inlet is a first gas inlet; and
the apparatus further comprises a second gas inlet downstream from the collecting surface.

10. The apparatus of claim 9 wherein the second gas inlet is adjustable.

11. A particle delivery apparatus, comprising:
a cutting head;
an abrasive delivery path extending from a hopper toward the cutting head;
a gas flow path extending from a gas inlet toward the cutting head;
a control junction joining the abrasive delivery path to the gas flow path, the control junction being configured to collect abrasive particles in a pile that blocks a flow of abrasive particles along the abrasive delivery path when (a) a gas flow rate at a portion of the gas flow path extending through a free space around the pile is less than a flow rate sufficient to partially or entirely displaced the pile and (b) a pressure differential between the hopper and the abrasive delivery path downstream from the control junction is less than a pressure differential sufficient to partially or entirely displaced the pile, wherein the control junction includes a collecting surface configured to support the pile;
an abrasive port at least proximate to the control junction; and
an elongated dispensing tube having a first end portion toward the hopper and a second end portion toward the collecting surface, wherein the abrasive port is at the second end portion, and wherein the dispensing tube is moveable relative to the colleting surface along an adjustment axis to adjust a distance between the abrasive port and the collecting surface.

12. The apparatus of claim 11 wherein an outer diameter of the dispensing tube at the second end portion is less than an outer diameter of the dispensing tube at the first end portion.

13. The apparatus of claim 11 wherein the collecting surface is curved about an axis generally perpendicular to the adjustment axis.

14. The apparatus of claim 11 wherein:
the dispensing tube is moveable relative to the collecting surface from a first end position to a second end position and through a range of intermediate positions; and
the second end portion of the dispensing tube contacts the collecting surface when the dispensing tube is in the first end position.

15. The apparatus of claim 14 wherein the dispensing tube includes a gasket at the second end portion configured to press against the collecting surface when the dispensing tube is in the first end position.

16. A particle delivery apparatus, comprising:
a cutting head;
an abrasive delivery path extending from a hopper toward the cutting head;
a gas flow path extending from a gas inlet toward the cutting head, the gas inlet including a vent configured to be open to the atmosphere, the gas inlet having a first state and a second, more open state;

a first conduit coupled to the cutting head;

a second conduit coupled to the hopper;

a T-shaped junction at an intersection of the first and second conduits;

an abrasive port at least proximate to the junction; and an elongated dispensing tube having a first end portion toward the hopper and a second end portion opposite to the first end portion, wherein the junction is configured to collect abrasive particles in a pile that blocks a flow of abrasive particles along the abrasive delivery path when (a) a gas flow rate at a portion of the gas flow path extending through a free space around the pile is less than a flow rate sufficient to partially or entirely displace the pile and (b) a pressure differential between the hopper and a portion of the abrasive delivery path downstream from the junction is less than a pressure differential sufficient to partially or entirely displace the pile;

the junction includes a collecting surface configured to support the pile, the dispensing tube is moveable relative to the collecting surface from a first end position to a second end position and through a range of intermediate positions to adjust a distance between the abrasive port and the collecting surface and thereby change a size of the pile, a size of the free space, or both, and the cutting head is configured to form a jet that draws gas along the gas flow path.

* * * * *